US007074079B2

(12) United States Patent
Higuchi

(10) Patent No.: US 7,074,079 B2
(45) Date of Patent: Jul. 11, 2006

(54) ELECTRIC CONNECTOR WITH REINFORCING TAB

(75) Inventor: Kunihiro Higuchi, Nissin (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/096,916

(22) Filed: Apr. 1, 2005

(65) Prior Publication Data

US 2005/0221667 A1 Oct. 6, 2005

(30) Foreign Application Priority Data

Apr. 2, 2004 (JP) ..... 2004-110208

(51) Int. Cl.
*H01R 13/73* (2006.01)

(52) U.S. Cl. ..... 439/566; 439/570

(58) Field of Classification Search ..... 439/566, 439/563, 570, 83, 553
See application file for complete search history.

(56) References Cited

U.S. PATENT DOCUMENTS 5,120,256 A * 6/1992 Walden ..... 439/553
5,259,789 A * 11/1993 Patel et al. ..... 439/570
5,318,464 A * 6/1994 DiMondi et al. ..... 439/553
5,395,265 A * 3/1995 DiMondi et al. ..... 439/553
5,591,050 A * 1/1997 Sueoka ..... 439/607
5,704,807 A * 1/1998 Sherman et al. ..... 439/570
6,325,655 B1 * 12/2001 Noda et al. ..... 439/342
6,361,332 B1 * 3/2002 Froude et al. ..... 439/83
6,478,617 B1 * 11/2002 Fan ..... 439/570
6,478,629 B1 * 11/2002 Li et al. ..... 439/668
6,645,005 B1 * 11/2003 Wu ..... 439/563
6,669,069 B1 * 12/2003 Suggs ..... 224/645
6,881,075 B1 * 4/2005 Huang et al. ..... 439/74
7,001,212 B1 * 2/2006 Juntwait ..... 439/566
2005/0221667 A1 * 10/2005 Higuchi ..... 439/566

FOREIGN PATENT DOCUMENTS

JP 10064608 3/1998

* cited by examiner

*Primary Examiner*—Alexander Gilman
(74) *Attorney, Agent, or Firm*—W. F. Fasse; W. G. Fasse

(57) ABSTRACT

An electric connector includes a housing and a reinforcing tab formed as a unitary L-shaped member having a horizontal piece and a vertical piece. The vertical piece is connected to the housing, and the horizontal piece is to be soldered onto a mounting counterpart member such as a printed circuit board. To enhance the soldering strength, the reinforcing tab is provided with a through hole that penetrates through the reinforcing tab or a concaved part that is concave from the reverse soldering face toward the front face of the reinforcing tab. The through hole or the concaved part straddles both the horizontal piece and the vertical piece of the reinforcing tab.

14 Claims, 9 Drawing Sheets

ELECTRIC CONNECTOR WITH REINFORCING TAB

BACKGROUND OF THE INVENTION

1. Field of the Invention

The present invention belongs to a field of electric connectors, and relates to an electric connector with reinforcing tab of which soldering strength to a mounting counterpart member such as a printed circuit board is enhanced.

2. Related Art

Japanese Unexamined Patent publication Heisei 10-64608 discloses an electric connector with fixing tab wherein said fixing tab is to be soldered onto a printed circuit board to mount the electric connector, and a part to be soldered of said fixing tab is provided with a through hole so as to widen a surface to which solder fillet sticks when said tab is soldered. The publication also discloses the electric connector wherein in place of said through hole, a face of the fixing tab, which is to contact the printed circuit board and to be soldered, is provided with a concaved part. This electric connector exhibits a greater soldering strength due to fillets that are formed, at the time of soldering, on the through hole or the concaved part provided in the fixing tab. Accordingly, even if large forces are exerted to the electric connector due to, for example, prying at the time of connecting, disconnecting or mating with the counterpart connector, such forces will be absorbed by the fixing tabs and will not reach the soldered parts of the contacts. Thus occurrence of loose connection and peeling of the soldered parts of the contacts can be prevented.

SUMMARY OF THE INVENTION

This fixing tab is also called as a reinforcing tab. Hitherto improvement in the soldering strength of this reinforcing tab in relation to a mounting counterpart member such as a printed circuit board has been keenly desired. On the other hand, it is also desired to avoid upsizing the reinforcing tab.

The present invention was made in view of these points, and its object is to increase the size of a fillet that is formed in the vicinity of a bend part, which, of a reinforcing tab being substantially bent into an L-shape, receives most of the forces when the electric connector is subjected to forces, and in turn, enhance the soldering strength to the mounting counterpart member without upsizing the reinforcing tab, increase the tolerance of peeling, absorb forces even if large forces are exerted to the electric connector so as to prevent such forces from influencing the soldered parts of the contacts, and in turn, to prevent occurrence of loose connection and peeling of soldered parts of the contacts.

The present invention as means to accomplish the above-mentioned objects is an electric connector with reinforcing tab, comprising a connector housing, and a reinforcing tab, which is formed by substantially bending a piece into an L-shape so that parts of the obverse face thereof come closer to each other and comprises a horizontal piece facing in the height direction and a vertical piece facing sidewise, and it is so structured that the vertical piece is provided on the connector housing, and the horizontal piece is to be soldered, on the reverse side thereof, onto a mounting counterpart member such as a printed circuit board. This electric connector with reinforcing tab is provided with a through hole that penetrates the reinforcing tab or a concaved part that concaves from the reverse face toward the obverse face of the reinforcing tab to straddle both the horizontal piece and the vertical piece.

When a reinforcing tab is soldered onto a mounting counterpart member such as a printed circuit board, a solder layer will be formed between the reverse face of the horizontal piece and the mounting counterpart member. Moreover, a fillet will be formed by solder between side end faces of the horizontal piece and the obverse face of the mounting counterpart member in such a way that the fillet spreads like bell-bottom toward the obverse face of the mounting counterpart member, and a fillet will be formed by solder between the reverse face of the bend part and the obverse face of the mounting counterpart member in such a way that the fillet spreads like bell-bottom toward the obverse face of the mounting counterpart member. Furthermore, a fillet will be formed by solder between the inner circumferential face of the through hole or the concaved part and the obverse face of the mounting counterpart member in such a way that the fillet spreads like bell-bottom toward the obverse face of the mounting counterpart member.

In that case, as the through hole or the concaved part is provided to straddle both the horizontal piece and the vertical piece, when compared with a fillet that is formed by a reinforcing tab, which is not provided with any through hole nor concaved part, the fillet in the vicinity of the bend part has a greater total length due to the presence of the through hole or the concaved part that extends into the horizontal piece when seen in the height direction, and in addition to it, the fillet is formed to a higher level along the internal circumferential face of the through hole or the concaved part. Hence the size of the fillet, which is formed in the vicinity of the bend part, will get larger, and of the reinforcing tab, this vicinity of the bend part will be most subjected to the forces when the electric connector with reinforcing tab is subjected to forces. Accordingly, without increasing the size of the reinforcing tabs, the soldering strength to the mounting counterpart member is increased, and in turn, the tolerance of peeling is increased. Even when the electric connector with reinforcing tab is subjected to a large force, this force will be absorbed by the reinforcing tabs and will not reach the soldered parts of the contacts, and in turn, occurrence of loose connection and peeling of a soldered part of a contact will be prevented.

Accordingly, as the electric connector with reinforcing tab is provided with a through hole or a concaved part straddling the horizontal piece and the vertical piece, the size of the fillet that is formed in the vicinity of the bend part, which, of the reinforcing tab, is the part that is most subjected to forces when the electric connector is subjected to forces, will get larger, thus without upsizing the reinforcing tabs, the soldering strength to the mounting counterpart member is increased, and in turn, the tolerance of peeling is increased. Even when the electric connector is subjected to a large force, this force will be absorbed by the reinforcing tabs and will not reach the soldered parts of the contacts, and in turn, occurrence of loose connection and peeling of a soldered part of a contact will be prevented.

The electric connector with reinforcing tab of the above-mentioned invention may be provided with a protruding piece, which protrudes from the inner circumferential face on the vertical piece side of the through hole in the height direction to the vicinity of the height of the reverse face of the horizontal piece.

With this arrangement, a layer of solder will be formed between the end faces of the top end of the protruding piece and the mounting counterpart member. Moreover, by solder, a fillet, which extends like bell-bottom toward the obverse face of the mounting counterpart member, will be formed between the outer circumferential face of the top end of the protruding piece and the obverse face of the mounting counterpart member. As a result, the size of the fillet that is formed in the vicinity of the bend part will get larger, and without increasing the size of the reinforcing tabs, the soldering strength to the mounting counterpart member is increased, and in turn, the tolerance of peeling is increased, hence occurrence of loose connection and peeling of soldered parts of contacts are prevented.

These electric connectors with reinforcing tab of the present invention may be provided with a curved part, which curves when seen in the height direction, is provided on a side end face of the horizontal piece.

With this arrangement, when seen in the height direction, as the total length of the fillets that are formed between the side end faces of the horizontal piece of the reinforcing tab and the obverse face of the mounting counterpart member is formed longer, without increasing the size of the reinforcing tabs, the soldering strength to the mounting counterpart member is increased, and in turn, the tolerance of peeling is increased. Thus occurrence of loose connection and peeling of soldered parts of contacts will be prevented.

PREFERRED EMBODIMENT OF THE INVENTION

Figure 1:
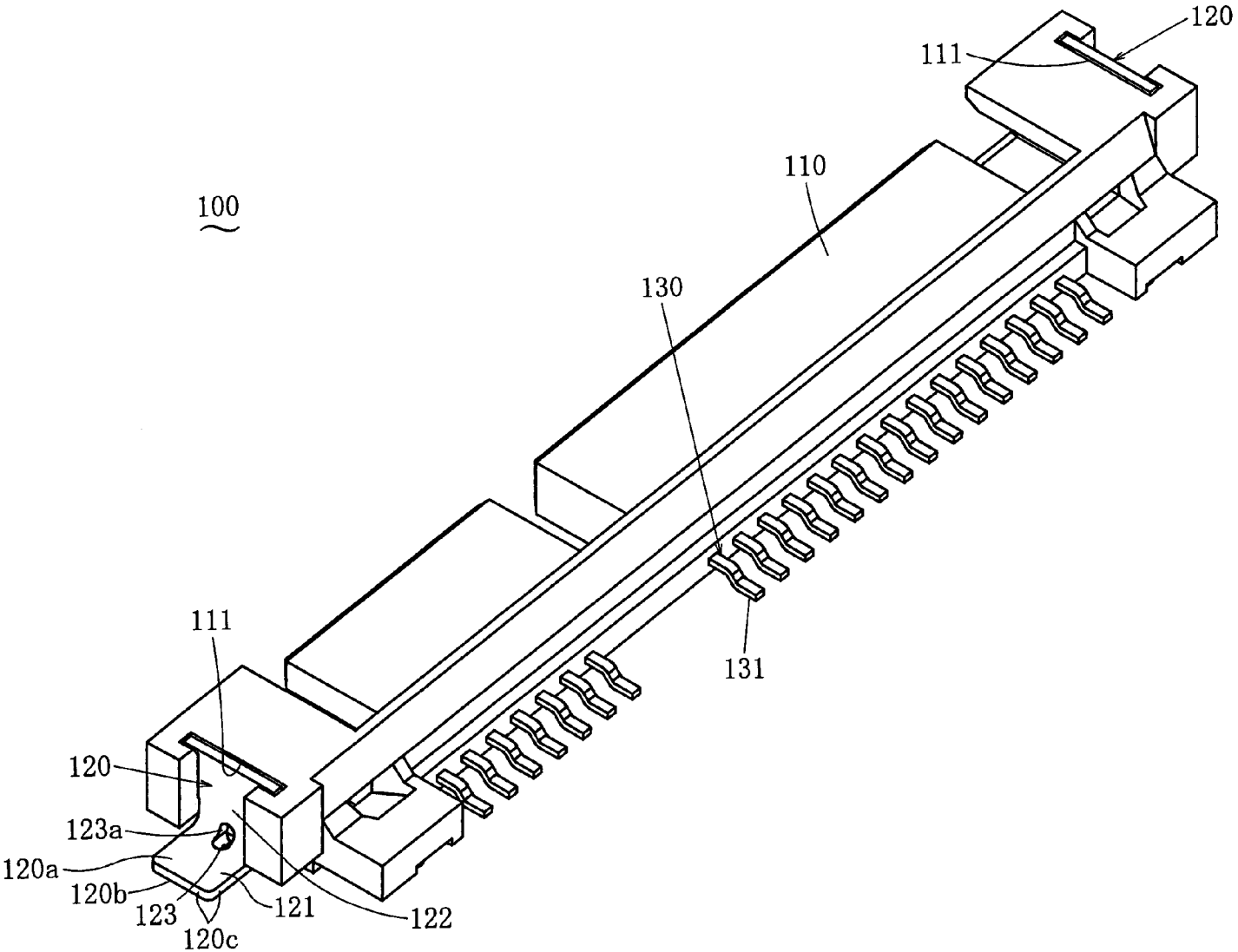
FIG. 1 is a perspective view illustrating an electric connector with reinforcing tab of the first embodiment.

In the following, some embodiments of the electric connector with reinforcing tab according to the present invention will be described. FIG. 1 illustrates the electric connector with reinforcing tab 100 of the first embodiment. This electric connector with reinforcing tab 100 comprises a connector housing 110 being formed of an insulative material, contacts 130, which are made of a conductive material, have a connecting part 131 being to come out of the connector housing 110 and are provided in the connector housing 110, and two reinforcing tabs 120. The connecting part 131 is to be soldered onto a mounting counterpart member 200 such as a printed circuit board. The connector housing 110 is formed, when seen in the height direction, into a substantially rectangular shape having two sides extending in the width direction and opposing to each other in the depth direction perpendicular to the width direction and two sides extending in the depth direction and opposing to each other in the width direction. The connecting part 131 of each contact 130 is arranged on one of the two sides extending in the width direction; the connecting parts 131 are arranged to be parallel to each other along said side. A concaved mating part (not illustrated) for receiving a counterpart electric connector (not illustrated) is provided on the other side. The reinforcing tab 120 is provided on each of two sides extending in the depth direction. When the counterpart electric connector is inserted into or withdrawn from the mating part of the electric connector with reinforcing tab 100 substantially along the depth direction, due to the insertion or the withdrawal, forces working in various directions will be exerted to the electric connector with reinforcing tab 100, but forces working in the depth direction will have the leading role. And due to prying, various moments will be exerted to the electric connector with reinforcing tab 100, but moments around an axis facing in the width direction will have the leading role. As a result, various forces will be exerted to the electric connector 100, but forces working in the height direction will have the leading role. The configuration and arrangement of the connector housing, the contacts and the reinforcing tabs of the electric connector with reinforcing tab according to the present invention are not limited in any way by this embodiment. For example, the electric connector with reinforcing tab of the present invention includes one wherein the mating part is convexed and it is arranged that this part is received into a concaved part of the counterpart electric connector. The present invention is extensively applicable to electric connectors with reinforcing tab wherein said connector is provided with a contact of which connecting part is out of the connector housing, a horizontal piece of at least one reinforcing tab faces a mounting counterpart member to be soldered, and the vertical piece thereof is provided on the connector housing. Accordingly, the directions of forces and moments to which the electric connector with reinforcing tab are subjected are varied. The mounting counterpart member in this context includes all members that have a face onto which the electric connector with reinforcing tab can be mounted, and includes, for example, a circuit body wherein a circuit is formed on a surface of a resin molding.

Figure 2:
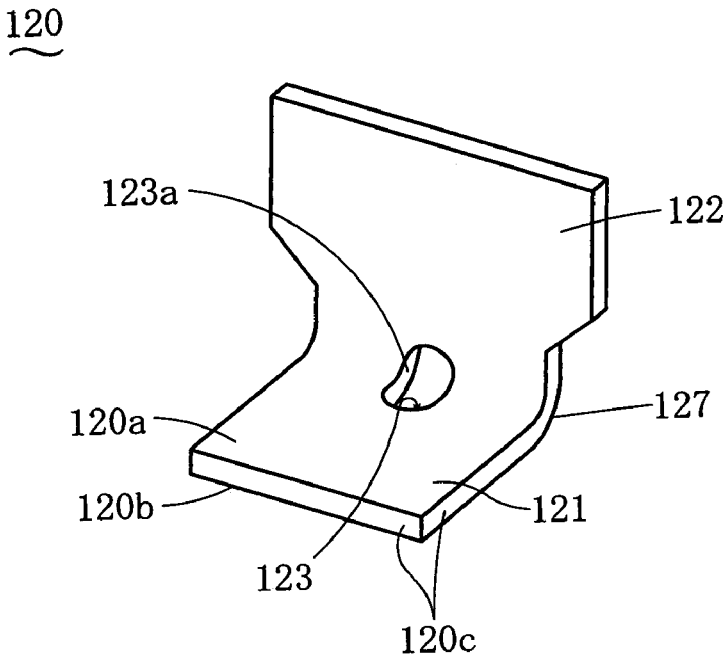
FIG. 2 is a perspective view illustrating a reinforcing tab of the electric connector with reinforcing tab of the first embodiment.
Figure 3:
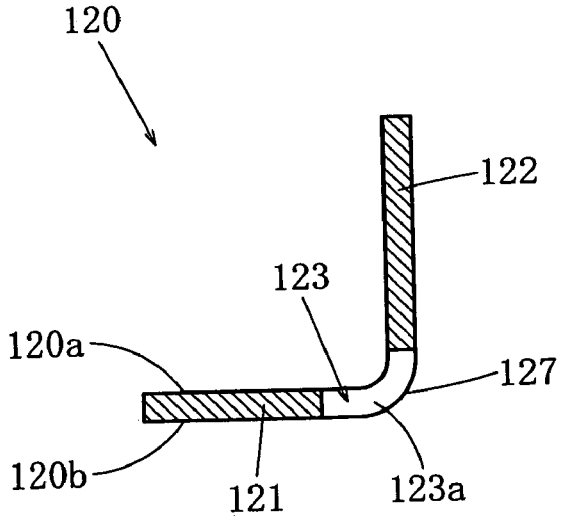
FIG. 3 is a sectional view illustrating the reinforcing tab of the electric connector with reinforcing tab of the first embodiment, said reinforcing tab being so sectioned that it has a through hole.

As shown in FIG. 2 and FIG. 3, the reinforcing tab 120 is formed by substantially bending a plate into an L-shape so that two parts of an obverse face thereof are brought closer to each other. In other words, the reinforcing tab 120 is formed by substantially bending the plate into an L-shape so that the bend angle on the obverse side is less than 180 degrees and the bend angle on the reverse side is greater than 180 degrees. Thus the reinforcing tab 120 comprises a horizontal piece 121 facing in the height direction and a vertical piece 122 facing sidewise. The direction of a face in this context agrees with the normal direction of the face. The vertical piece 122 is to be provided on the connector housing 110 and the horizontal piece 121 is to be soldered, on its reverse face 120*b* side, to a mounting counterpart member 200 such as a printed circuit board. In the case of this embodiment, the connector housing 110 is provided with press-fit chambers 111 concaving from the bottom face in the height direction, and the vertical pieces 122 are provided on the connector housing 110 by press-fitting the vertical pieces 122 into the press-fit chambers 111 from the bottom side in the height direction. The structure for providing the connector housing with vertical pieces is not limited to this one; it may be exemplified by an embodiment wherein vertical pieces are cast into the connector housing by first setting vertical pieces in a mold for the connector housing and then molding the connector housing, and an embodiment wherein the connector housing is covered by, for example, a metal shell and parts of this shell constitute the reinforcing tabs. The reinforcing tab 120 is so arranged that the vertical piece 122 thereof faces in the width direction, but the direction of the reinforcing tab 120 when the reinforcing tab 120 is provided on the connector housing 110 is not limited to that.

The reinforcing tab 120 is provided with a through hole 123 penetrating the reinforcing tab 120, said through hole 123 extends from the horizontal piece 121 into the vertical piece 122. In other words, the through hole 123 penetrates the reinforcing tab 120 from the obverse face 120*a* thereof to the reverse face 120*b* thereof, the through hole 123 is centered around the bend part 127 between the horizontal piece 121 and the vertical piece 122, extends from the horizontal piece 121 into the vertical piece 122, and straddles both the horizontal piece 121 and the vertical piece 122.

As shown in FIG. 4 through FIG. 7, when the reinforcing tab 120 is soldered onto a mounting counterpart member 200 such as a printed circuit board, a solder layer 310 will be formed between the reverse face 120*b* of the horizontal piece 121 thereof and the mounting counterpart member 200. Moreover, a fillet 320 will be formed by solder between side end faces 120*c* of the horizontal piece 121 and the obverse face of the mounting counterpart member 200 in such a way that the fillet 320 spreads like bell-bottom toward the obverse face of the mounting counterpart member 200. A fillet 320 will be formed by solder between the reverse face 120*b* of the bend part 127 and the obverse face of the mounting counterpart member 200 in such a way that the fillet 320 spreads like bell-bottom toward the obverse face of the mounting counterpart member 200. Furthermore, a fillet 320 will be formed by solder between the inner circumferential face 123*a* of the through hole 123 and the obverse face of the mounting counterpart member 200 in such a way that the fillet 320 spreads like bell-bottom toward the obverse face of the mounting counterpart member 200. When, for example, the counterpart electric connector is withdrawn from or inserted into the mating part or the mating part is subjected to prying, the greater part of the forces being exerted to the mating part will be exerted to the reinforcing tabs 120, and as the reinforcing tabs 120 are formed by substantially bending a plate into an L-shape, these forces will be loaded to the vicinity of the bend part 127 in a concentrated manner. In the case of this embodiment, as the reinforcing tabs 120 are located closer to the mating part than the connecting parts 131 of the contacts 130, most of the forces being exerted to the mating part will be exerted to the reinforcing tabs 120, and the forces exerted to the bend part 127 are very large.

Figure 16:
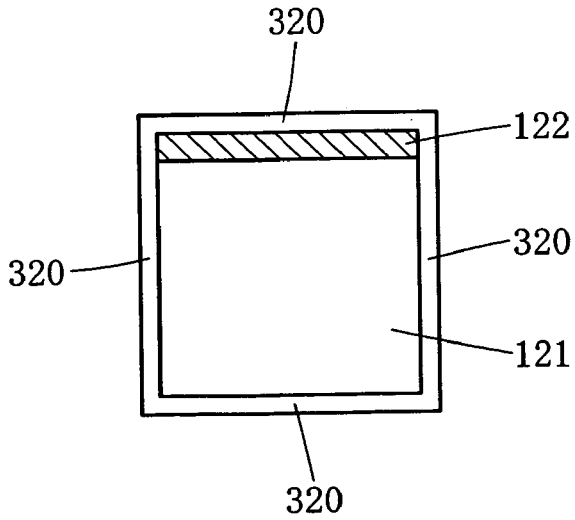
FIG. 16 is a diagram comparable to FIG. 7 and illustrates a reinforcing tab of a comparative example wherein no through hole nor concaved part is provided.

In that case, as the through hole 123 is provided to straddle both the horizontal piece 121 and the vertical piece 122, when compared with a fillet 320 that is formed by a reinforcing tab, which comprises, as shown in FIG. 16, a horizontal piece 121 and a vertical piece 122 but is not provided with any through hole nor concaved part, the fillet 320 in the vicinity of the bend part 127 has a greater total length due to the presence of the through hole 123 that extends into the horizontal piece 121 when seen in the height direction, and in addition to it, the fillet 320 is formed to a higher level along the internal circumferential face 123*a* of the through hole 123. Hence the size of the fillet 320, which is formed in the vicinity of the bend part 127, will get larger, and of the reinforcing tab, this vicinity of the bend part 127 will be most subjected to the forces when the electric connector with reinforcing tab 100 is subjected to forces. Accordingly, without increasing the size of the reinforcing tabs 120, the soldering strength to the mounting counterpart member 200 is increased, and in turn, the tolerance of peeling is increased. Even when the electric connector with reinforcing tab 100 is subjected to a large force, this force will be absorbed by the reinforcing tabs 120 and will not reach the soldered parts of the contacts, and in turn, occurrence of loose connection and peeling of a soldered part of a contact will be prevented. The size of the through hole 123 is not limited, however, it is preferable that the fillet 320 that is formed between the inner circumferential face 123*a* of the through hole 123 and the obverse face of the mounting counterpart member 200 is formed higher than the fillet 320 that is formed between the reverse face 120*b* of the bend part 127 and the obverse face of the mounting counterpart member 200.

Figure 8:
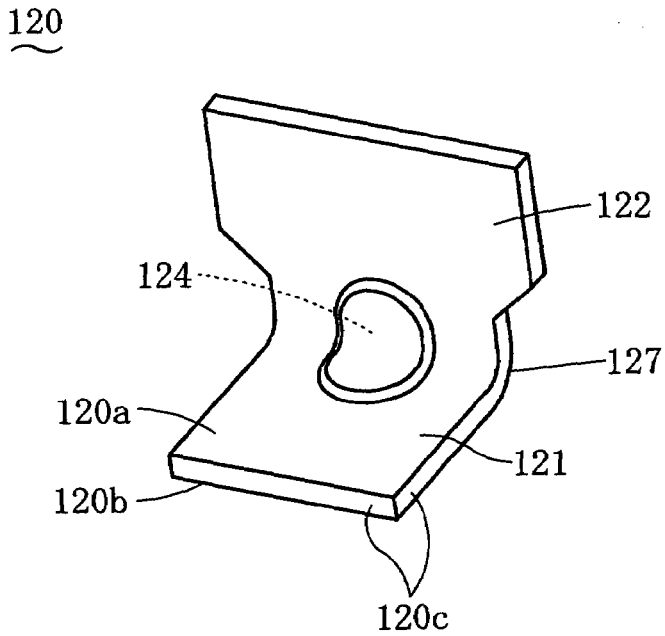
FIG. 8 is a perspective view illustrating a reinforcing tab of an electric connector with reinforcing tab of the second embodiment.
Figure 9:
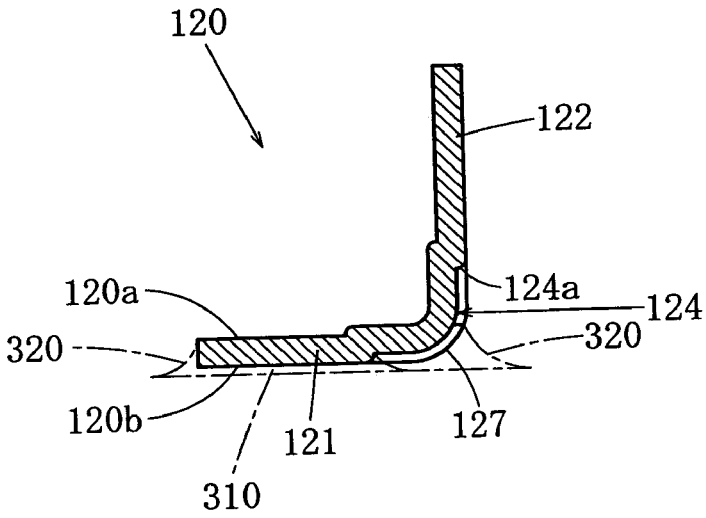
FIG. 9 is a sectional view of the reinforcing tab of the electric connector with reinforcing tab of the second embodiment, said reinforcing tab is sectioned to contain a concaved part.

Next, other embodiments will be described. FIG. 8 and FIG. 9 illustrate an electric connector with reinforcing tab of the second embodiment. In the case of this electric connector with reinforcing tab 100, a concaved part 124 is provided in place of the through hole 123 of the first embodiment. The structure in other aspects is similar to that of the electric connector with reinforcing tab 100 of the first embodiment. In other words, this reinforcing tab 120 is provided with the concaved part 124, which is concaved from the reverse face 120*b* toward the obverse face 120*a* of the reinforcing tab 120 and extends from the horizontal piece 121 into the vertical piece 122. The concaved part 124 is concaved from the reverse face 120*b* of the reinforcing tab 120 in the plate thickness direction, and the concaved part 124 is centered around the bend part 127 that is located between the horizontal piece 121 and the vertical piece 122, extends to both the horizontal piece 121 and the vertical piece 122 and straddles both the horizontal piece 121 and the vertical piece 122. The concaved part 124 is formed to have a substantially constant depth.

As shown in FIG. 9 with imaginary lines, when the reinforcing tab 120 is soldered onto a mounting counterpart member 200 such as a printed circuit board, a solder layer 310 will be formed between the reverse face 120*b* of the horizontal piece 121 and the mounting counterpart member 200. Moreover, by soldering, a fillet 320 will be formed between the side end faces 120*c* of the horizontal piece 121 and the obverse face of the mounting counterpart member 200 in such a way that the fillet 320 spreads like bell-bottom towards the obverse face of the mounting counterpart member 200, and furthermore, by soldering, a fillet 320 will be formed between the reverse face 120*b* of the bend part 127 and the obverse face of the mounting counterpart member 200 in such a way that the fillet 320 spreads like bell-bottom towards the obverse face of the mounting counterpart member 200. Moreover, by soldering, a fillet 320 will be formed between the inner circumferential face 124*a* of the concaved part 124 and the obverse face of the mounting counterpart member 200 in such a way that the fillet 320 extends like bell-bottom towards the obverse face of the mounting counterpart member 200.

In that case, as the concaved part 124 is provided to straddle both the horizontal piece 121 and the vertical piece 122, when compared with a fillet 320 that is formed by a reinforcing tab, which comprises, as shown in FIG. 16, a horizontal piece 121 and a vertical piece 122 but is not provided with any through hole nor concaved part, the fillet 320 in the vicinity of the bend part 127 has a greater total length due to the presence of the concaved part 124 that extends into the horizontal piece 121 when seen in the height direction, and in addition to it, the fillet 320 is formed to a higher level along the internal circumferential face 124*a* of the concaved part 124. Hence the size of the fillet 320, which is formed in the vicinity of the bend part 127, will get larger, and of the reinforcing tab 120, this vicinity of the bend part 127 will be most subjected to the forces when the electric connector with reinforcing tab 100 is subjected to forces. Accordingly, without increasing the size of the reinforcing tabs 120, the soldering strength to the mounting counterpart member 200 is increased, and in turn, the tolerance of peeling is increased. Even when the electric connector with reinforcing tab 100 is subjected to a large force, this force will be absorbed by the reinforcing tabs 120 and will not reach the soldered parts of the contacts, and in turn, occurrence of loose connection and peeling of a soldered part of a contact will be prevented. The size of the concaved part 124 is not limited, however, it is preferable that the fillet 320 that is formed between the inner circumferential face 124*a* of the concaved part 124 and the obverse face of the mounting counterpart member 200 is formed higher than the fillet 320 that is formed between the reverse face 120*b* of the bend part 127 and the obverse face of the mounting counterpart member 200.

Figure 10:
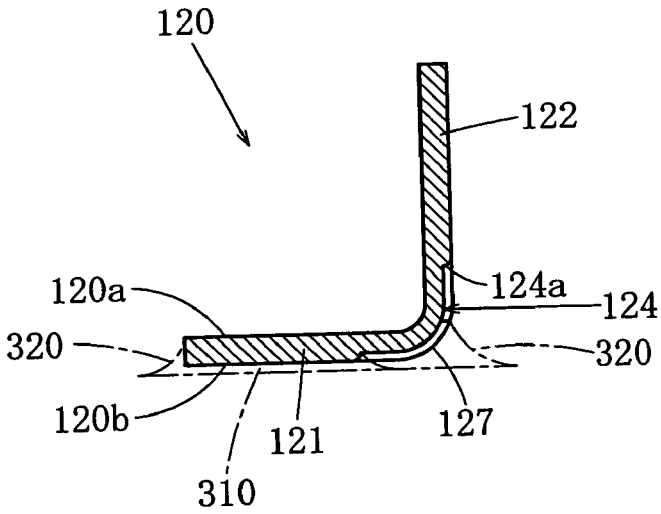
FIG. 10 is a sectional view of a reinforcing tab of an electric connector with reinforcing tab of a modification of the second embodiment, said reinforcing tab is sectioned to contain a concaved part.

FIG. 10 illustrates a modification of the electric connector with reinforcing tab 100 of the second embodiment. In the case of the second embodiment, due to the provision of the concaved part 124, a portion of the obverse face 120*a* of the reinforcing tab 120, said portion corresponding to the concaved part 124, swells, however, in the case of this modification, there is no swell like that. The functions and effects that are exhibited by the electric connector with reinforcing tab 100 of this modification are similar to those of the second embodiment (refer to the imaginary lines of FIG. 10).

Figure 11:
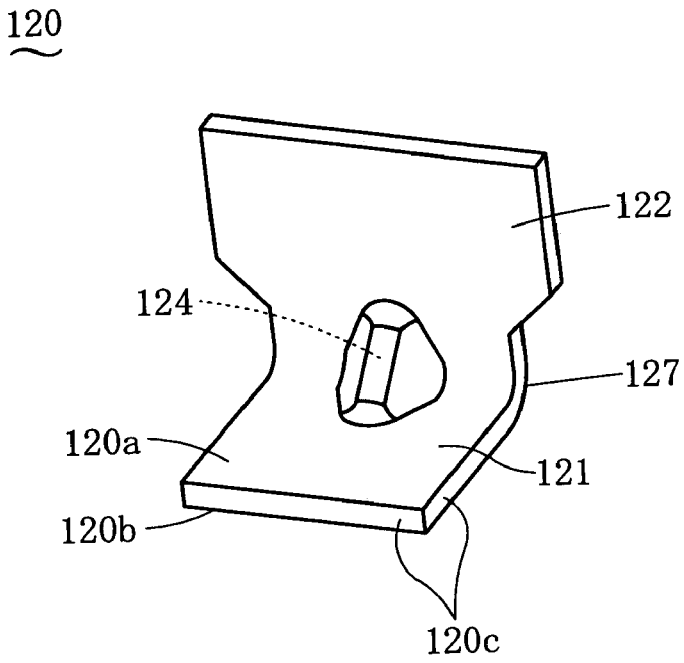
FIG. 11 is a perspective view illustrating a reinforcing tab of an electric connector with reinforcing tab of the third embodiment.
Figure 12:
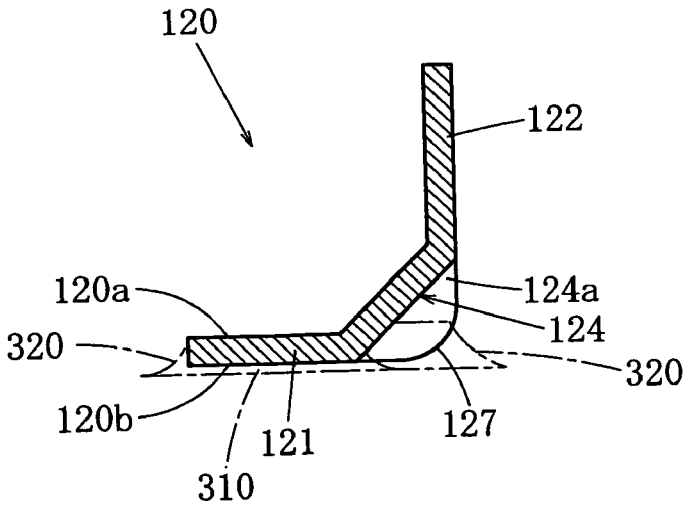
FIG. 12 is a sectional view illustrating the reinforcing tab of the electric connector with reinforcing tab of the third embodiment, said reinforcing tab is sectioned to contain a concaved part.

FIG. 11 and FIG. 12 illustrate an electric connector with reinforcing tab 100 of the third embodiment. In the cases of the second embodiment and the modification thereof, the depth of the concaved part 124 is substantially formed constant, however, in the case of the third embodiment, the concaved part 124 is substantially formed to get deeper towards its center. The structure in other aspects is similar to those of the second embodiment and the modification thereof. When the concaved part 124 is formed deep as described above, as shown by imaginary lines in FIG. 12, the fillet 320 is formed to a higher level along the inner circumferential face 124*a* of the concaved part 124. As a result, the size of the fillet 320, which is formed in the vicinity of the bend part 127, will get larger, and of the reinforcing tab 120, this vicinity of the bend part 127 will be most subjected to the forces when the electric connector with reinforcing tab 100 is subjected to forces. Accordingly, without increasing the size of the reinforcing tabs 120, the soldering strength to the mounting counterpart member 200 is increased, and in turn, the tolerance of peeling is increased. The size of the concaved part 124 is not limited, however, it is preferable that the fillet 320 that is formed between the inner circumferential face 124*a* of the concaved part 124 and the obverse face of the mounting counterpart member 200 is formed higher than the fillet 320 that is formed between the reverse face 120*b* of the bend part 127 and the obverse face of the mounting counterpart member 200.

Figure 13:
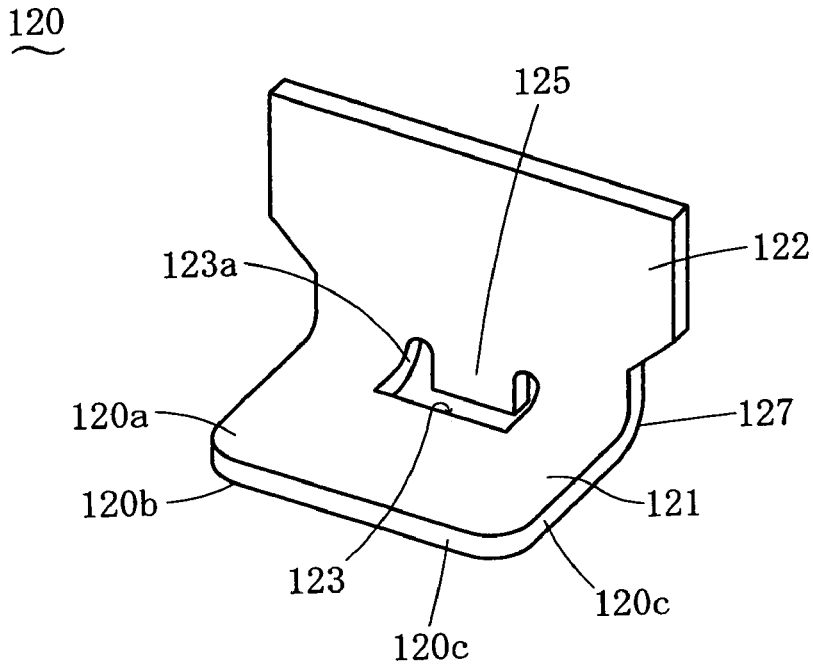
FIG. 13 is a perspective view illustrating a reinforcing tab of an electric connector with reinforcing tab of the fourth embodiment.
Figure 14:
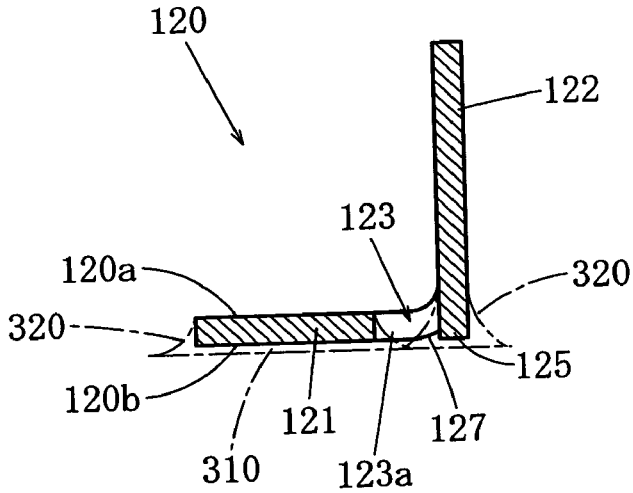
FIG. 14 is a sectional view illustrating the reinforcing tab of the electric connector with reinforcing tab of the fourth embodiment, said reinforcing tab is sectioned to contain a through hole.

FIG. 13 and FIG. 14 illustrate an electric connector with reinforcing tab 100 of the fourth embodiment. In the case of this electric connector with reinforcing tab 100, in addition to the structure of the first embodiment, a protruding piece 125 is provided, which protrudes from the inner circumferential face 123*a*, on the vertical piece side, of the through hole 123, in the height direction, to a vicinity of the height of the reverse face 120*b* of the horizontal piece 121. In other words, the protruding piece 125 protrudes in the height direction from a portion of the inner circumferential face 123*a* on the vertical piece side of the reinforcing tab 120, said portion being the remotest in the height direction from the bend part 127, and the top end face of the protruding piece 125 is substantially at the same level with the reverse face 120*b* of the horizontal piece 121.

With this arrangement, in addition to the functions and effects that are exhibited by the first embodiment, the following functions and effects will be exhibited. As shown by imaginary lines in FIG. 14, a layer of solder will be formed between the end faces of the top end of the protruding piece 125 and the mounting counterpart member 200. Moreover, by solder, a fillet 320, which extends like bell-bottom toward the obverse face of the mounting counterpart member 200, will be formed between the outer circumferential face of the top end of the protruding piece 125 and the obverse face of the mounting counterpart member 200. As a result, the size of the fillet 320 that is formed in the vicinity of the bend part 127 will get larger, and without increasing the size of the reinforcing tabs 120, the soldering strength to the mounting counterpart member 200 is increased, and in turn, the tolerance of peeling is increased. Thus occurrence of loose connection and peeling of soldered parts of contacts will be prevented. Moreover, as the protruding piece 125 can be provided by a small piece that is generated when the through hole 123 is punched out, it is easy to produce and advantageous in terms of cost.

Figure 15:
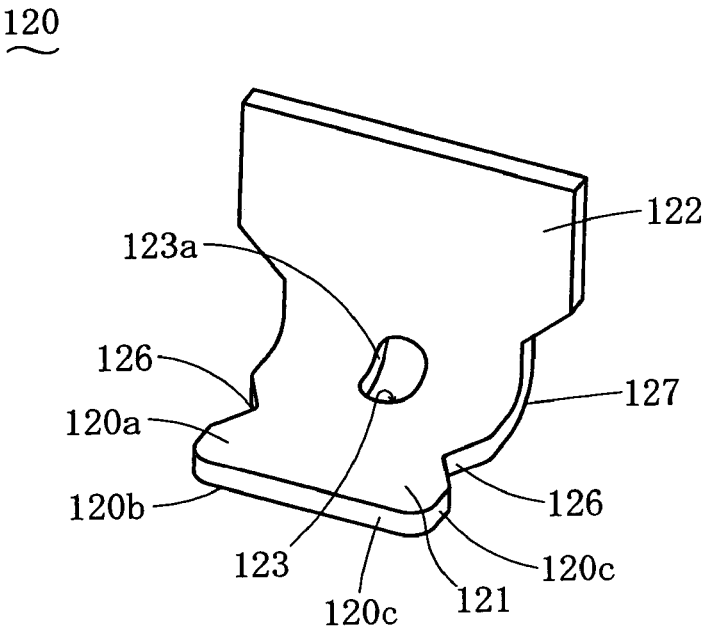
FIG. 15 is a perspective view illustrating a reinforcing tab of an electric connector with reinforcing tab of the fifth embodiment.

FIG. 15 illustrates an electric connector with reinforcing tab 100 of the fifth embodiment. In the case of this electric connector with reinforcing tab 100, in addition to the structure of the first embodiment, curved parts 126, which curve when seen in the height direction, are provided on side end faces 120*c* of the horizontal piece 121.

With this arrangement, in addition to the functions and effects that are exhibited by the first embodiment, the following functions and effects will be exhibited. When seen in the height direction, as the total length of the fillets 320 that are formed between the side end faces 120*c* of the horizontal piece 121 of the reinforcing tab 120 is formed longer, without increasing the size of the reinforcing tabs 120, the soldering strength to the mounting counterpart member 200 is increased, and in turn, the tolerance of peeling is increased. Thus occurrence of loose connection and peeling of soldered parts of contacts will be prevented.

The reverse face 120*b* of the bend part 127 may be formed circular arc or angular. The present invention includes embodiments wherein some features of the above-mentioned embodiments are combined appropriately.

What is claimed is:

1. An electric connector with reinforcing tab, comprising a connector housing, and a reinforcing tab, which is formed by substantially bending a piece into an L-shape so that parts of an obverse face thereof come closer to each other and which comprises a horizontal piece facing in a height direction and a vertical piece facing sidewise, the electric connector is so structured that the vertical piece is provided on the connector housing, and the horizontal piece is to be soldered, on a reverse side thereof, onto a mounting counterpart member, a through hole that penetrates through the reinforcing tab or a concaved part that concaves from the reverse face toward the obverse face of the reinforcing tab is provided to straddle both the horizontal piece and the vertical piece, and the reverse side of the horizontal piece protrudes in the height direction outwardly beyond and spaced away from a surface of the connector housing adjacent to the reinforcing tab and adapted to face toward the mounting counterpart member.

2. The electric connector with reinforcing tab as recited in claim 1, wherein a curved part, which curves when seen in the height direction, is provided on a side end face of the horizontal piece.

3. The electric connector with reinforcing tab as recited in claim 1, wherein the reinforcing tab has the concaved part and not the through hole, and wherein the concaved part is a closed concavity without perforation through the reinforcing tab.

4. The electric connector with reinforcing tab as recited in claim 1, wherein the through hole or the concaved part is open, unobstructed and available to receive solder therein, in a state of the reinforcing tab fastened to the connector housing.

5. The electric connector with reinforcing tab as recited in claim 1, further comprising a protruding piece, which protrudes from an inner circumferential face on a vertical piece side of the through hole in the height direction to a vicinity of a height of the reverse face of the horizontal piece.

6. The electric connector with reinforcing tab as recited in claim 2, wherein a curved part, which curves when seen in the height direction, is provided on a side end face of the horizontal piece.

7. An electric connector for solder-mounting on a mounting surface, said electric connector comprising:

a connector housing having a mounting side adapted to face toward the mounting surface when said electric connector is mounted thereon;

plural electric contacts connected to and exposed outwardly from said housing, and positioned relative to said mounting side 50 as to be adapted to be solder-connected to the mounting surface; and a reinforcing tab including a first tab leg and a second tab leg that are integrally joined to one another at a bend to form a monolithic L-shaped structure of said reinforcing tab having an obverse side that spans a bend angle of less than 180° at said bend and a reverse side that spans a bend angle of more than 180° at said bend;

wherein:

said first tab leg is secured to said housing so as to secure said reinforcing tab to said housing, and said second tab leg protrudes from said housing along or parallel to a plane of said mounting side of said housing;

said reinforcing tab has therein a recess selected from the group consisting of a through hole that perforates through said reinforcing tab and an imperforate concavity that is concave on said reverse side of said reinforcing tab;

said recess is formed in and spans said first tab leg, said bend and said second tab leg; and in an assembled state in which said reinforcing tab is secured to said housing, said recess is open, unobstructed and available to receive solder therein when said reinforcing tab is solder-mounted onto the mounting surface.

8. The electric connector according to claim 7, wherein said recess is said through hole.

9. The electric connector according to claim 7, wherein said recess is said imperforate concavity.

10. The electric connector according to claim 7, wherein said reverse side of said second tab leg extends parallel to and offset from said plane of said mounting side of said housing, so that said reverse side of said second tab leg protrudes outwardly beyond and away from said mounting side.

11. A combination including an electric connector solder-mounted on a circuit board, said combination comprising:

a circuit board having a mounting surface;

a solder; and an electric connector including:

a connector housing having a mounting side facing toward the mounting surface;

plural electric contacts connected to and exposed outwardly from said housing at said mounting side, and being solder-connected to said mounting surface by some of said solder; and a reinforcing tab including a first tab leg and a second tab leg that are integrally joined to one another at a bend to form a monolithic L-shaped structure of said reinforcing tab having an obverse side that spans a bend angle of less than 180° at said bend and a reverse side that spans a bend angle of more than 180° at said bend;

wherein:

said first tab leg is secured to said housing so as to secure said reinforcing tab to said housing, and said second tab leg protrudes from said housing along or parallel to a plane of said mounting aide of said housing;

said reinforcing tab has therein a recess selected from the group consisting of a through hole that perforates through said reinforcing tab and an imperforate concavity that is concave on said reverse side of said reinforcing tab;

said recess is formed in and spans said first tab leg, said bend and said second tab leg; and said reinforcing tab is solder-mounted onto said mounting surface by some of said solder, which penetrates and engages into said recess.

12. The combination according to claim 11, wherein said recess is vacant except for said solder therein.

13. The combination according to claim 11, wherein said solder fills a portion of said recess in said second tab leg and a portion of said recess in said bend.

14. The combination according to claim 11, wherein said solder completely fills all of a sectional area of said recess in said second tab leg.

* * * * *

UNITED STATES PATENT AND TRADEMARK OFFICE

CERTIFICATE OF CORRECTION

Figure 4:
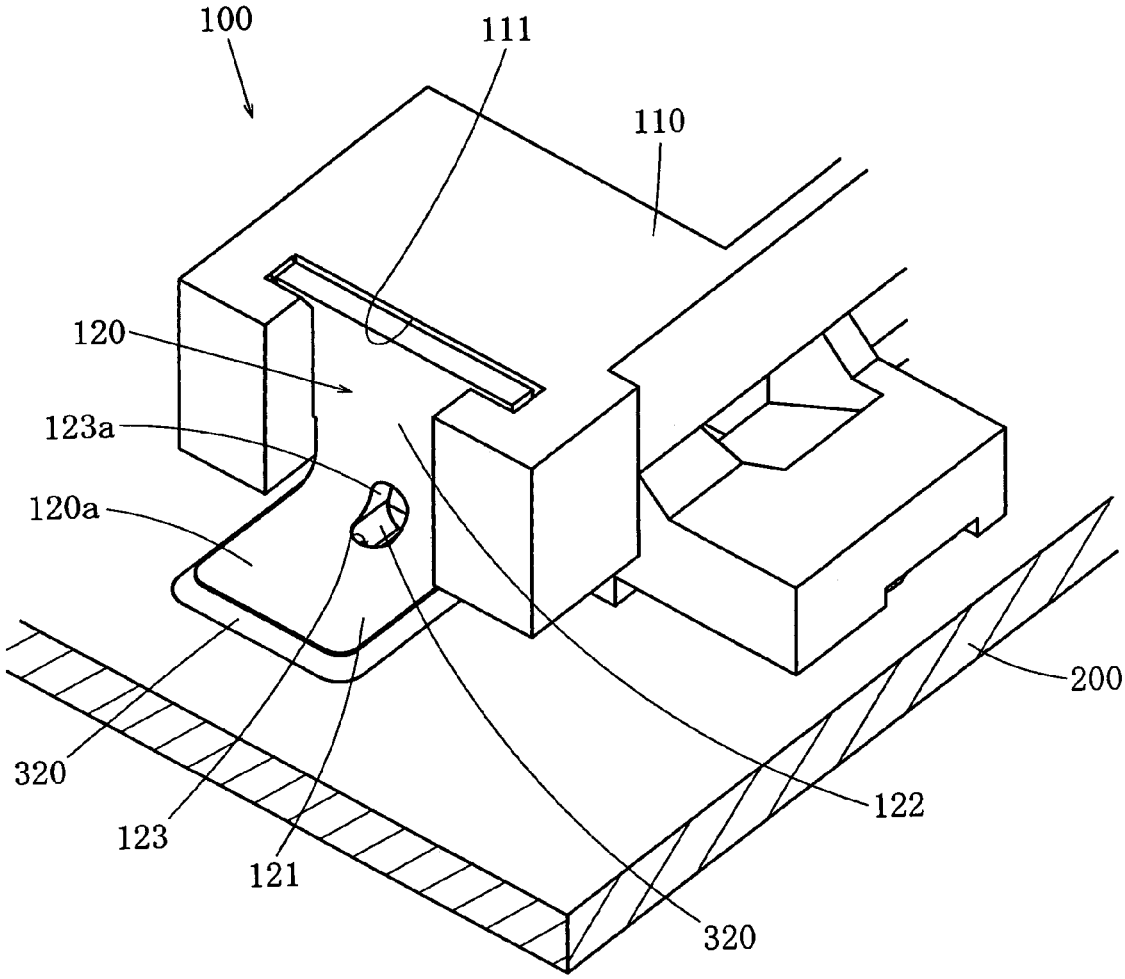
FIG. 4 is a perspective view illustrating a portion of the electric connector with reinforcing tab of the first embodiment, said electric connector being soldered onto a mounting counterpart member.
Figure 5:
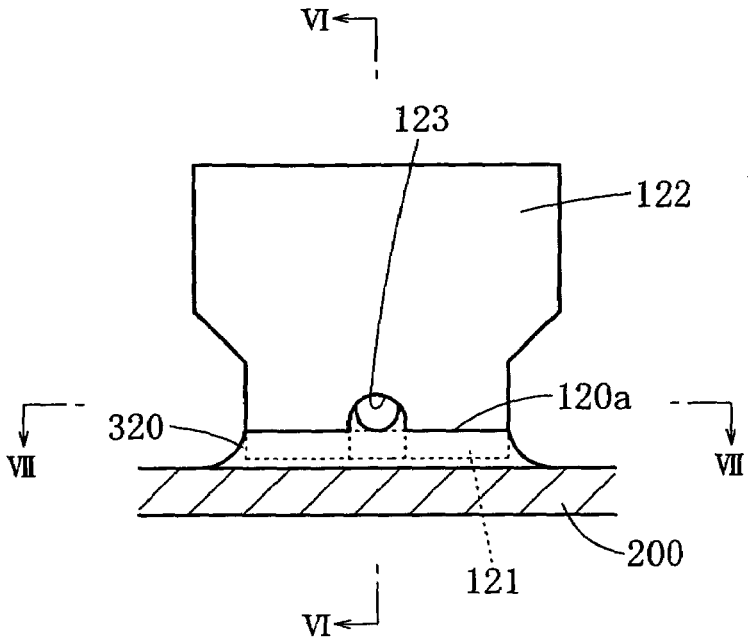
FIG. 5 is a front view illustrating only the reinforcing tab of the electric connector with reinforcing tab of the first embodiment when the electric connector is soldered onto the mounting counterpart member.
Figure 6:
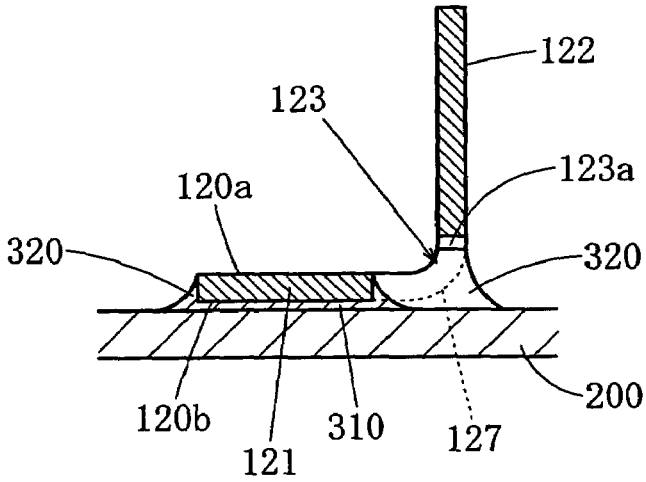
FIG. 6 is a sectional view along the line VI—VI of FIG. 5.
Figure 7:
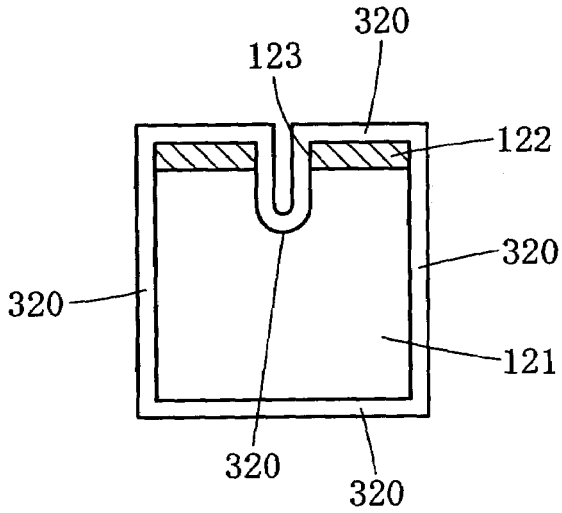
FIG. 7 is a sectional view along the line VII—VII of FIG. 5.

PATENT NO. : 7,074,079 B2
APPLICATION NO. : 11/096916
DATED : July 11, 2006
INVENTOR(S) : Higuchi It is certified that error appears in the above-identified patent and that said Letters Patent is hereby corrected as shown below:

Title page,
Item [75], Inventor,
After "Higuchi," replace "Nissin" by --Nissin-shi--;

Column 3,
Line 9, before "electric", replace "These" by --The--;
after "electric", replace "connectors" by --connector--;
after "with" insert --a--;
Line 11, after "direction," insert --and which--;

Column 6,
After Line 47 insert the following paragraph:
--Also, as can be seen in Figs. 1 and 4, in this embodiment the reverse face of the horizontal piece 121 of the reinforcing tab 120 protrudes in the height direction outwardly beyond and spaced away from (e.g. below) a surface (e.g. a bottom surface) of the connector housing 110 adjacent to the reinforcing tab 120. Thus, when the horizontal piece 121 of the reinforcing tab 120 is soldered onto the mounting counterpart member 200 as shown in Fig. 4, there is a space between the facing surfaces of the mounting counterpart member 200 and the connector housing 110 adjacent to the reinforcing tab 120.--;

Column 9,
Line 58, after "claim", replace "2," by --5,--;

UNITED STATES PATENT AND TRADEMARK OFFICE

CERTIFICATE OF CORRECTION

PATENT NO. : 7,074,079 B2
APPLICATION NO. : 11/096916
DATED : July 11, 2006
INVENTOR(S) : Higuchi It is certified that error appears in the above-identified patent and that said Letters Patent is hereby corrected as shown below:

Column 10,
Line 1, after "side", replace "50" by --so--;
Line 57, after "mounting", replace "aide" by --side--.

Signed and Sealed this

Nineteenth Day of December, 2006

JON W. DUDAS
*Director of the United States Patent and Trademark Office*